United States Patent [19]

Jansen

[11] 4,209,167

[45] Jun. 24, 1980

[54] ARM WRESTLING APPARATUS

[76] Inventor: Patrick W. Jansen, Belmont Rte., Lavina, Mont. 59046

[21] Appl. No.: 804,000

[22] Filed: Jun. 6, 1977

[51] Int. Cl.[2] ..... A63B 23/00

[52] U.S. Cl. ..... 272/67; 272/135; 272/DIG. 5; 272/142; 73/380

[58] Field of Search ..... 73/379, 380, 381; 272/93, 67, 136, 140, 142, 135, 68; 273/1 E

[56] References Cited

U.S. PATENT DOCUMENTS

| | | | |
|---|---|---|---|
| 496,094 | 4/1893 | Peloquin | 272/67 |
| 929,281 | 7/1909 | Brodeur | 272/142 X |
| 948,140 | 2/1910 | Johnson | 73/381 |
| 2,805,657 | 9/1957 | Shaffer | 124/16 |
| 3,563,542 | 2/1971 | Wellman | 73/380 R |
| 3,662,602 | 5/1972 | Weiss | 272/67 |
| 3,735,983 | 5/1973 | Ortiz | 273/1 E |
| 3,938,389 | 2/1976 | Kella | 272/67 |
| 3,947,025 | 3/1976 | Hobby | 272/67 |
| 3,982,757 | 9/1976 | McDonnell | 73/381 |
| 4,063,727 | 12/1977 | Hall | 272/67 |

*Primary Examiner*—Richard J. Johnson
*Attorney, Agent, or Firm*—Arthur L. Urban

[57] ABSTRACT

An arm wrestling apparatus including a base, an upstanding arm member pivotally connected to the base, a hand-engaging portion on the free end of the arm member, adjustable biasing means urging pivotal movement of the upstanding arm member in one direction, rotatable means associated with the biasing means to control the tension therein, tension-indicating means associated the biasing means, locking means for selectively maintaining the arm member in an upstanding position, and stop means associated with the base adjacent the arm member to limit the extent of movement thereof.

8 Claims, 8 Drawing Figures

ARM WRESTLING APPARATUS

This invention relates to a novel entertainment apparatus and more particularly relates to entertainment apparatus for use by a single individual.

Through the years, people have conceived a wide variety of games and similar devices to entertain themselves, their children, friends, etc. Some of these games and devices have gained wide acceptance for varying periods of time. However, most have only fleeting popularity as a fad or craze with only a very few having lasting appeal. Also, such games or devices generally are designed for a particular age group, that is, either children or adults. Very few appeal to persons of widely varying ages and both males and females. In addition, many games and other amusement devices require more than one player.

The present invention provides a novel apparatus for testing the strength of the user. Furthermore, the novel apparatus of the invention provides an appropriate test of strength for individuals of widely different capability from children to senior citizens and both males and females. Moreover, the apparatus is capable of providing increasingly difficult tests of strength for individuals on strength building programs. A further advantage of the apparatus is its ability to be used by a single individual without a partner.

Other benefits and advantages of the present invention will be apparent from the following description and the accompanying drawings in which.

Figure 1:
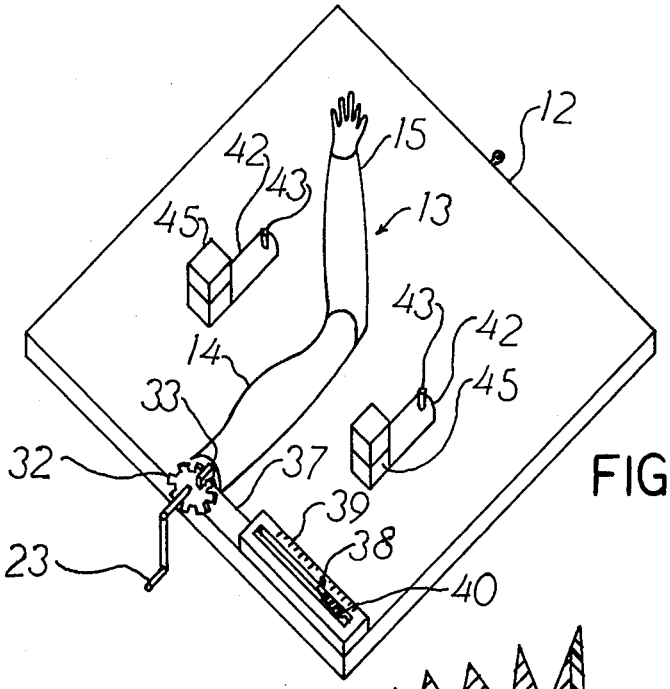
FIG. 1 is a schematic illustration in perspective of one embodiment of the novel arm wrestling apparatus of the present invention.
Figure 2:
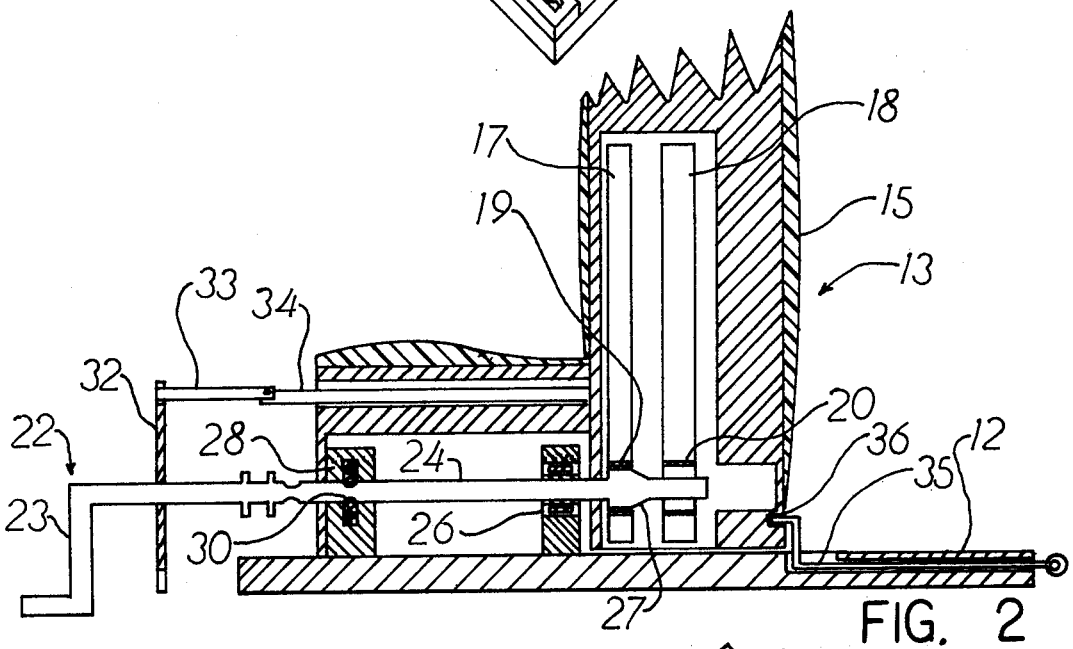
FIG. 2 is an enlarged side elevation partially in section of the arm wrestling apparatus shown in FIG. 1 with the crank shaft engaging the forward spring.
Figure 3:
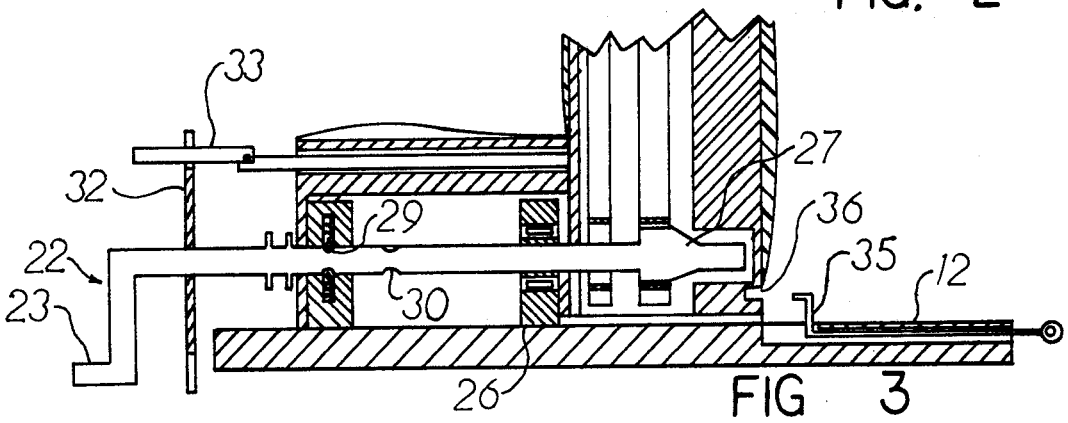
FIG. 3 is an enlarged side elevation partially in section of the arm wrestling apparatus shown in FIG. 1 with the crank shaft engaging the rearward spring.
Figure 4:
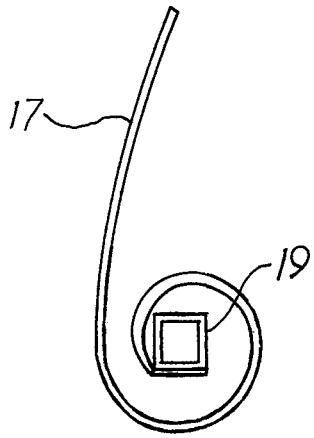
FIG. 4 is a side view of one of the springs of the arm wrestling apparatus shown in FIGS. 2 and 3.

As shown in FIGS. 1–5 of the drawings, one embodiment of the novel arm wrestling apparatus 11 of the present invention includes a base 12 on which is mounted an assembly 13 simulating a human arm. The assembly 13 has a fixed portion 14 simulating the part of an arm between the shoulder and the elbow. Also, the assembly 13 has a pivotally mounted upstanding arm member 15 simulating a forearm. At the end of arm member 15 is attached a removable, hand-engaging portion 16.

Within arm member 15 are located spiral springs 17 and 18 with substantially straight portions extending longitudinally of the arm member. These straight portions as shown in the drawings form the core of the arm member 15 and provide structural support therefor. Affixed to the inside coiled end of the springs are sockets 19 and 20, respectively. A crank 22 with a handle 23 and a shaft 24 is slidably and rotatably supported on bearing supporting brackets 26 mounted on base 12. The end of crank shaft 24 which has an enlarged section 27 extends through sockets 19 and 20. Enlarged section 27 is of a configuration to selectively engage either socket 19 of spring 17 or socket 20 of spring 18 adjacent thereto. In this way, the shaft 24 selectively supports spring 17 or 18 and thereby provides support for the arm member 15 which is disposed over the straight portions of the springs. The position of shaft 24 within socket 19 or socket 20 is maintained by a spring biased ball latch 28 which surrounds the shaft and selectively engages grooves 29 and 30 in the shaft.

Crank 22 has a ratchet wheel 32 affixed thereto near the handle 23. A pivoting pawl 33 is mounted on support 34 to engage the ratchet wheel 32. A locking pin 35 disposed within base has an exposed end which is engageable with an opening 36 in arm member 15.

Figure 5:
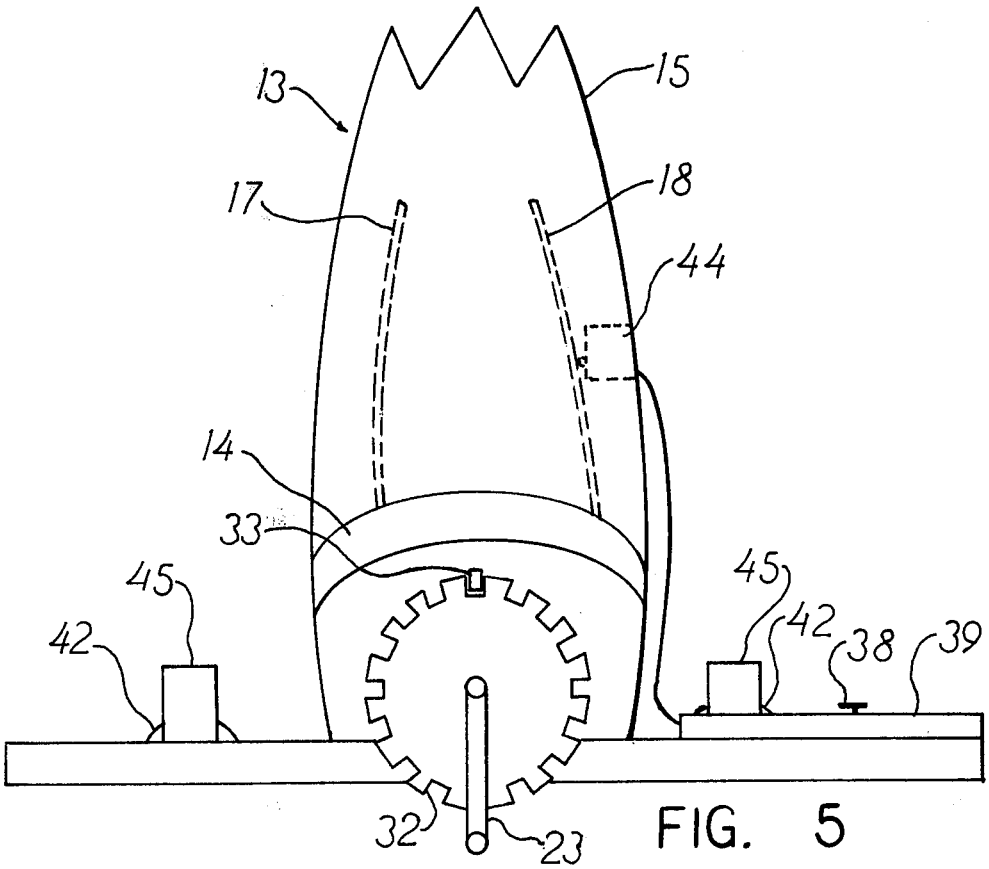
FIG. 5 is an end view partially in section of another embodiment of the arm wrestling apparatus of the invention.

The degree of tension within spring 17 or 18 may be determined by suitable tension-indicating mechanisms such as those shown in FIGS. 1 and 5 of the drawings. As shown in FIG. 1, one end of a flexible cable or chain 37 is attached to a pointer 38 of an elongated scale indicator 39 and the opposite end attached to and wrapped around crank shaft 24. A spring 40 attached to pointer 38 returns the pointer to a zero position when the tension in cable 37 is released.

FIG. 5 shows another mechanism for operating the scale indicator. Load cells 44 are attached to the straight portions of springs 17 and 18. Load cells 44 which are connected electrically to the indicator, respond to changes in the tension in springs 17 and 18 to send a signal to the indicator. The load cells 44 may be of the pnuematic, hydraulic, extensimeter, magno-elastic or nuclear-electronic form conventionally employed in weighing devices.

Stop means 42 are positioned on base 12 to limit the extent to which the arm member 15 can be lowered toward the base 12. If desired, switches 43 or other actuating means may be incorporated into the stops 42 to activate a signal (lamp or alarm) 45.

In the operation of the arm wrestling apparatus shown in FIGS. 1–5 of the drawings, crank 22 is slid longitudinally of fixed arm portion 14 so that enlarged section 27 of the shaft 24 engages socket 19 or 20 in springs 17 or 18, respectively. Socket 19 will be engaged if the individual is right handed and socket 20 if the user is left handed. The crank handle 23 is rotated in a clockwise direction with socket 20 and counterclockwise if socket 19 is engaged. As the crank handle 23 is rotated, ratchet wheel 32 also rotates and pawl 33 drops into each indentation of the wheel as it reaches the position of the pawl. This insures that the tension in the spring will not be released when handle 23 is released. Likewise, as the crank handle 23 is rotated, cable 37 will be wound on shaft 24 drawing pointer 38 along scale 39. The scale 39 may be marked with appropriate designations to indicate the amount of pressure required to move the arm member 15 at a particular pointer setting. When the desired pressure setting has been reached, locking pin 35 which extends into opening 36 in arm member 15 maintains the arm member in an upstanding position until the individual is in position to test his strength.

The person using the apparatus then positions himself on the side of the base 12 opposite to the crank 22 and places his elbow next to the pivot point of arm member 15 with his forearm along side the arm member. He places the removable hand-engaging portion 16 into proper orientation on arm member 15 to permit it to be grasped by his own hand.

Then pin 35 is withdrawn from opening 36 in arm member 15 allowing the tension in spring 17 or 18 to act and force arm member 15 toward his forearm. If the individual has greater strength than the tension in the spring, he will be able to overcome the effect of the spring and force the arm member 15 down toward base 12 and against switch 43 of stop 42 which will activate a signal 45. On the other hand, if the tension in the spring is greater than the strength of the individual, arm member 15 will force the individual's arm toward base 12 and against switch 43 to activate signal 45 on the opposite side.

On succeeding attempts, the individual can increase or decrease the amount of tension in the spring by rotating the crank handle 23 more or fewer turns until he achieves a level which enables him to overcome the effect of the spring with great difficulty. This will provide him with an indication of his maximum strength.

When a person desires to test the strength in his other arm, crank 22 is moved longitudinally so that the enlarged section 27 of crank shaft 24 engages the socket of the other spring. Then the crank handle 23 is rotated in the opposite direction until the desired pressure or tension setting is achieved. The pawl 22 then locks the crank 22 and ratchet wheel 32 to maintain the tension in the spring. When the individual has placed his arm in the proper position beside arm member 15 and has oriented hand-engaging portion 16, he grasps portion 16 with his hand and releases pin 35 from opening 36 thereby freeing arm member 15 for the test of strength.

Figure 6:
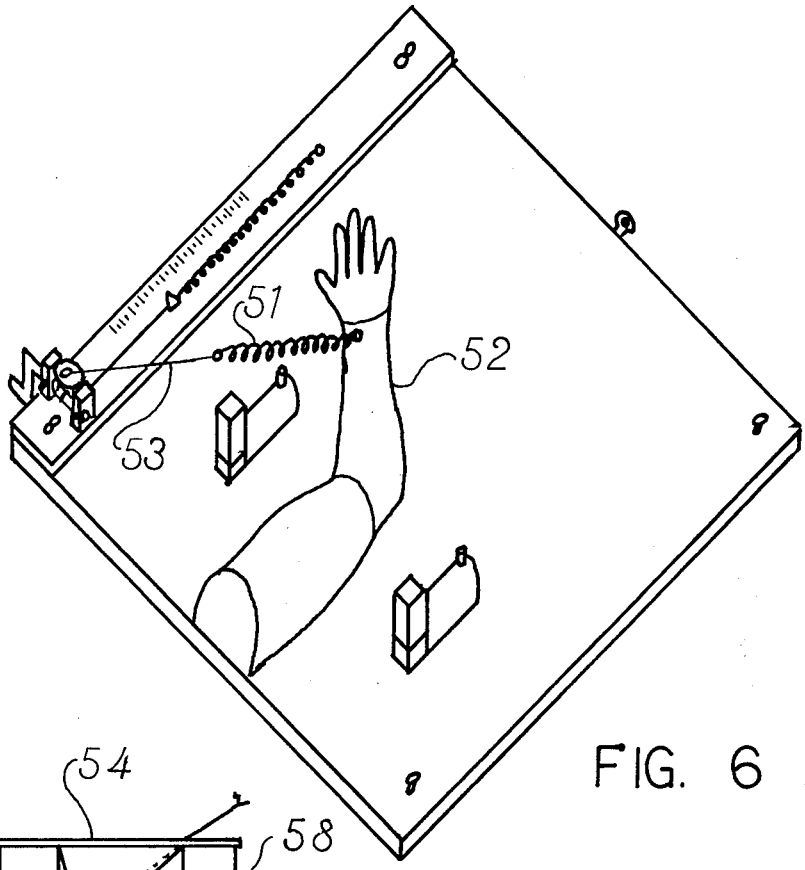
FIG. 6 is a schematic illustration in perspective of a further embodiment of the arm wrestling apparatus of the present invention.
Figure 7:
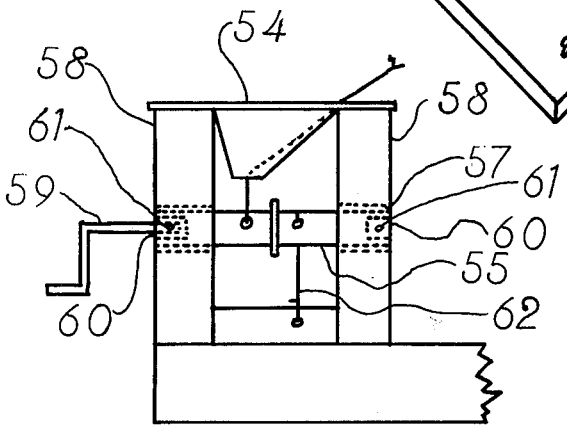
FIG. 7 is an enlarged side view of the crank assembly portion of the arm wrestling apparatus shown in FIG. 6.

In the arm wrestling apparatus of the present invention shown in FIGS. 6 and 7, an external spring 51 attached at one end to the free end of arm member has its opposite end attached to a cable 53. Cable 53 passes through a funnel 54 and is attached to a rotatable shaft 55 carried by bearings 57 disposed within supports 58. A crank handle 59 is engageable with openings 60 in shaft 55. Also, a locking pin 61 is is engageable with shaft 55 to prevent rotation of the shaft. A second cable 62 is affixed to shaft 55 and extends along tension-indicating assembly 63 to a pointer 64 to which is secured a spring 65.

Indicator assembly 63 is retained on base 67 by pins 68 extending therefrom which are engageable with openings 69 in the assembly 63. Suitable switches 70 and signals 71 may be mounted on base 67.

In the operation of the arm wrestling apparatus of the invention shown in FIGS. 6 and 7, handle 59 is rotated to increase the tension in spring 51 by winding cable 53 on shaft 55. At the same time, cable 62 winds on shaft 55 pulling pointer 64 attached thereto along a scale in assembly 63. When the desired tension is reached, the shaft 55 is locked by pin 61. The apparatus then may be used as a test of strength in the manner described above with regard to the arm wrestling apparatus of FIGS. 1-5. While the apparatus of FIGS. 6 and 7 is shown to be set up for a right handed person, the apparatus can be adapted for a left handed individual by switching the position of the indicator assembly 63 to the opposite side of the bass 67 over pins 68. Similarly, handle 59 can be switched to the opposite end of shaft 55.

Figure 8:
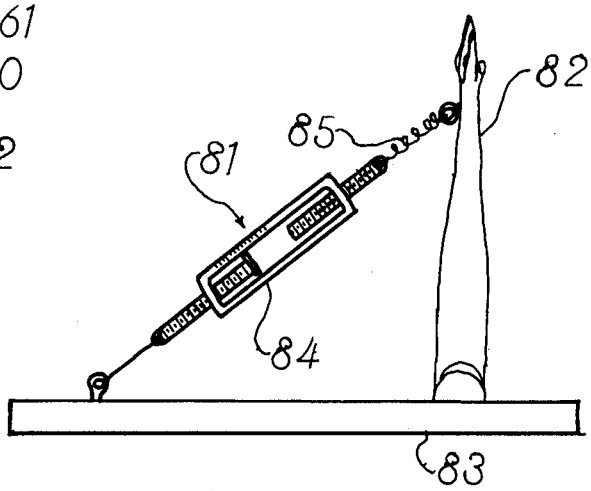
FIG. 8 is a fragmentary view of a spring assembly of another embodiment of the arm wrestling apparatus of the present invention.

Another form of the arm wrestling apparatus of the present invention is shown in FIG. 8 of the drawings. As shown, a spring assembly 81 is attached between the free end of arm member 82 and an eye bolt 86 in a corner of base 83. A turnbuckle 84 is included to provide control of the tension in spring 85.

The arm wrestling apparatus shown in FIG. 8 is operated by rotating turnbuckle 84 to increase the tension in spring 85. The degree of tension can be oberved on a scale on the turnbuckle 84. The apparatus may be adapted for an opposite handed person by attaching the spring assembly 81 to a second eye bolt (not shown) at a different point on base 63. The use of a turnbuckle 84 provides a simple, low cost means for achieving varying degrees of tension in a spring. The spring assembly 81 as shown in FIG. 8 includes the biasing means as well as the means for controlling the tension and the tension-indicating means all in a single unit.

The above description and the accompanying drawings show that the present invention provides a novel arm wrestling apparatus which affords a test of strength for a single individual. Furthermore, the apparatus of the invention provides individuals of widely different strength capabilities with appropriate tests commensurate with their own abilities. Thus, the arm wrestling apparatus is suitable for use by children and adults of both sexes. Also, the apparatus provides a capability for progressively more difficult tests for individuals on strength building programs. Moreover, the arm wrestling apparatus of the invention is simple to operate and can be used easily and conveniently. In addition, the apparatus is of a design which can be produced in quantity relatively inexpensively.

It will be apparent that various modifications can be made in the specific apparatus described in detail above and shown in the drawings within the scope of the invention. For example, other electrical or mechanical means can be employed to indicate the level of tension in the springs. Therefore, the invention is to be limited only by the following claims.

What is claimed is:

1. An arm wresting apparatus including a base, an upstanding arm member pivotally connected to said base, a hand-engaging portion on the free end of said arm member, adjustable biasing means urging pivotal movement of said upstanding arm member in one direction, rotatable means associated with said biasing means to control the tension therein, tension-indicating means associated with said biasing means, locking means for selectively maintaining said arm member in an upstanding position, and stop means associated with said base adjacent said arm member to limit the extent of movement thereof; said biasing means including a spiral spring disposed within said arm member and said spring having a substantially straight portion extending longitudinally of said pivotable arm member.

2. An arm wrestling apparatus according to claim 1 wherein said rotatable means includes a crank and ratchet.

3. An arm wrestling apparatus according to claim 1 wherein said apparatus includes two adjacent oppositely wound coil springs.

4. An arm wrestling apparatus according to claim 3 wherein said rotatable means includes a crank and ratchet, which crank is slidable longitudinally to selectively engage one of said two adjacent oppositely would coil springs.

5. An arm wrestling apparatus according to claim 1 wherein said tension-indicating means includes an elongated scale.

6. An arm wrestling apparatus according to claim 5 wherein said tension-indicating means includes flexible means connecting said crank with said elongated scale.

7. An arm wrestling apparatus according to claim 1 wherein said tension-indicating means includes a load cell.

8. An arm wrestling apparatus according to claim 1 wherein said stop means includes actuating means for a signal.

* * * * *